US007320236B2

(12) United States Patent
Monneret et al.

(10) Patent No.: US 7,320,236 B2
(45) Date of Patent: Jan. 22, 2008

(54) DEVICE THAT MAKES IT POSSIBLE TO LOCK AND UNLOCK, BY MEANS OF A KEY, A STOPPER OR COVER ON A FRAME

(75) Inventors: Jean-Jacques Monneret, Lyons (FR); Claudio Pierpaoli, Rome (IT)

(73) Assignee: Norinco, Saint Crepin Ibouvillers (FR)

( * ) Notice: Subject to any disclaimer, the term of this patent is extended or adjusted under 35 U.S.C. 154(b) by 295 days.

(21) Appl. No.: 11/104,134

(22) Filed: Apr. 12, 2005

(65) Prior Publication Data

US 2005/0241349 A1 Nov. 3, 2005

(30) Foreign Application Priority Data

Apr. 15, 2004 (FR) ..... 04 03952

(51) Int. Cl.
*B65D 55/14* (2006.01)

(52) U.S. Cl. ..... 70/169; 70/379 R; 292/57; 292/256

(58) Field of Classification Search ..... 70/169, 70/379 R, 380, 134; 292/57, 58, 60–62, 292/256, 257

See application file for complete search history.

(56) References Cited

U.S. PATENT DOCUMENTS

| | | | | | |
|---|---|---|---|---|---|
| 47,537 | A * | 5/1865 | Ford | 292/62 |
| 1,396,478 | A * | 11/1921 | Turney | 292/57 |
| 1,822,110 | A * | 9/1931 | Raymond | 292/60 |
| 1,956,029 | A * | 4/1934 | Holmes | 24/590.1 |
| 2,269,264 | A * | 1/1942 | Haim | 292/62 |
| 2,677,338 | A * | 5/1954 | Sassetti | 109/59 R |
| 2,860,904 | A * | 11/1958 | Barry et al. | 292/256 |
| 3,161,037 | A * | 12/1964 | Lagerquist | 70/169 |
| 3,302,964 | A * | 2/1967 | Barry | 292/57 |
| 3,689,757 | A * | 9/1972 | Vilshammer | 362/364 |
| 3,847,344 | A * | 11/1974 | Kulczycki et al. | 410/77 |
| 4,337,972 | A * | 7/1982 | Gill | 292/67 |
| 4,465,328 | A * | 8/1984 | Tihanyi et al. | 312/215 |
| 4,492,394 | A * | 1/1985 | Dignan | 292/64 |
| 4,556,244 | A * | 12/1985 | Bisbing | 292/65 |
| 4,907,716 | A * | 3/1990 | Wankel et al. | 220/326 |
| 5,076,080 | A * | 12/1991 | Fuss et al. | 70/125 |
| 5,688,093 | A * | 11/1997 | Bowers | 411/552 |
| 5,690,460 | A * | 11/1997 | Attanasio | 411/551 |
| 5,732,580 | A * | 3/1998 | Garnault et al. | 70/422 |
| 6,199,414 | B1 * | 3/2001 | Chang | 70/168 |
| 6,296,286 | B2 * | 10/2001 | Glaser et al. | 292/198 |
| 6,568,226 | B1 * | 5/2003 | Ramsauer | 70/127 |
| 6,802,962 | B1 * | 10/2004 | Browne et al. | 210/164 |

FOREIGN PATENT DOCUMENTS

| | | |
|---|---|---|
| EP | 0305245 | 3/1989 |
| EP | 0594468 | 4/1994 |
| EP | 0761885 | 3/1997 |
| WO | WO 02/059425 | 8/2002 |

* cited by examiner

*Primary Examiner*—Suzanne Dino Barrett
(74) *Attorney, Agent, or Firm*—Ladas & Parry LLP

(57) ABSTRACT

A device for locking and unlocking, with a key, a cover on a frame. The rotor of the lock for this device has a cylindrical barrel mounted for rotation in the cover and being interdependent in rotation with the slide bolt and a cylindrical axle with head mounted loosely in the barrel. The device is used in the area of road works.

9 Claims, 6 Drawing Sheets

DEVICE THAT MAKES IT POSSIBLE TO LOCK AND UNLOCK, BY MEANS OF A KEY, A STOPPER OR COVER ON A FRAME

BACKGROUND OF THE INVENTION

The present invention concerns a device that makes it possible to lock and unlock, by means of a key, a stopper or cover on a frame.

It can be used in traffic route equipment, such as, for example, a manhole cover.

SUMMARY OF THE INVENTION

A locking and unlocking device such as this is known as comprising a lock that forms a unit with the stopper that has an access opening to the lock for the key. This key comprises an arm, having at its end a part forming a bushing that makes it possible to manipulate the lock when the key is introduced into the opening of the stopper from a locking position, in which a slide bolt of the lock is held captive by a catch of the frame to an unlocking position, for which the slide bolt is released from the catch and the key is held captive in the stopper opening. The lock also comprises a rotor mounted with rotation in the stopper and accessible through the opening of the stopper, the rotor being coupled to the slide bolt, perpendicular to the latter. When the key is introduced into the stopper in locked position of same on the frame and is operated to unlock the stopper from the frame, the assembly made up by the rotor and the slide bolt pivots from its position captive in the catch to its position where it is released from same.

This known device has the disadvantage that the rotor, which is directly accessible from the outside across the opening of the stopper, can be operated by people with bad intentions using a tool other than the one necessary for operating this lock, in an attempt to fraudulently access the equipment installed in the manhole.

The object of the present invention is to eliminate the disadvantage above by proposing a locking and unlocking device with key for a stopper or cover on a frame, comprising a lock that forms a unit with the stopper, which has an access opening to the lock for the key, comprising an arm having at its end a part forming a bushing that makes it possible to operate the lock when the key is introduced into the opening of the stopper, from a locking position in which the slide bolt of the lock is held captive by a catch on the frame to an unlocking position for which the slide bolt is disengaged from the catch and the key is held captive in the opening of the stopper, the lock also comprising a rotor mounted with rotation in the stopper, accessible through the opening and coupled with the slide bolt, perpendicular to the latter in such a way as to allow pivoting of the slide bolt around the longitudinal axis of the rotor due to the action of the key between its positions when it is captive with and disengaged from the catch and which is characterized in that the rotor of the lock comprises a generally cylindrical barrel mounted with rotation in the stopper and being attached in rotation to the slide bolt and a cylindrical axle mounted loosely in the barrel, of which the head engages axially in the bushing of the key when it is introduced into the cavity of the stopper.

Advantageously, the slide bolt is made up of a flat rigid plate comprising, near one of its ends, a hole in which two diametrically opposed radial arc-shaped notches and a third radial arc-shaped notch pointed toward the active opposite free end of the slide bolt plate; the barrel crosses the bottom wall of the cavity of the stopper and comprises a circular head with radial pin lodged in the hole of the slide bolt with the pin engaged in the third notch of the slide bolt, the cylindrical head of the cylindrical axle mounted loosely being in contact on the circular head of the barrel, the bushing of the key comprises two parallel, diametrically opposed external pegs that are able to engage in the two opposite notches, respectively, of the slide bolt in locked position of the stopper on the frame across from two diametrically opposed grooves of the lateral wall of the cavity overhanging the two opposite notches of the slide bolt and making it possible to move in rotation around one-quarter of a turn, the cylindrical axle assembly, barrel and slide bolt plate by turning the key in the corresponding direction for moving the slide bolt to its unlocking position in which the key is captive in the stopper by its two pegs retained axially in two longitudinal recesses, respectively, in the lateral wall of the cavity.

According to one embodiment, the length of each passage groove for a peg of the key bushing is less than the length of the notch that it overhangs of the slide bolt plate in locked position of the stopper on the frame in such a way that the notch would be inaccessible to a tool, such as a screwdriver, introduced into the opening of the stopper and the groove to prevent any fraudulent operation of the slide bolt using this tool.

Each peg of the key bushing is in the shape of a reversed L, of which the small branch is connected radially to the bushing and the other branch that is parallel to the arm of the key projects beyond the opening part of the bushing.

The slide bolt plate and the circular head of the barrel are in contact with the inside face of the bottom wall of the stopper cavity and the means elastically holding the head of the barrel in contact with the bottom wall and the cylindrical head of the cylindrical axle on the head of the barrel comprise an elastic element, such as a spring, mounted coaxially on the part of the barrel located on the outside of the bottom wall by being prestressed between the outside face of this wall and a contact washer retained axially with respect to the barrel by a pin crossing the free end of the cylindrical axle projecting from the barrel.

The elastic element is in contact on the outside face of the bottom wall by way of a wavy washer that is connected with rotation to the barrel and cooperating with four recesses made in this outside face and spaced regularly around the passage hole of the barrel across the bottom wall at the time of rotation of the barrel to position the slide bolt at one or the other of its locking and unlocking positions of the stopper on the frame.

The barrel comprises a flat surface cooperating with a flat surface of the wavy washer to move the latter along in rotation when the slide bolt pivots.

The slide bolt projects to the outside of the lateral wall of the cavity of the stopper across a slot making possible the pivoting of the slide bolt around one-quarter of a revolution.

BRIEF DESCRIPTION OF THE DRAWING FIGURES

The invention will be better understood, and other goals, characteristics, details and advantages of same will be seen more clearly in the explanatory description to follow with reference to the attached schematic drawings given only by way of example, illustrating an embodiment of the invention, and in which.

DETAILED DESCRIPTION OF THE PREFERRED EMBODIMENTS

Figure 1:
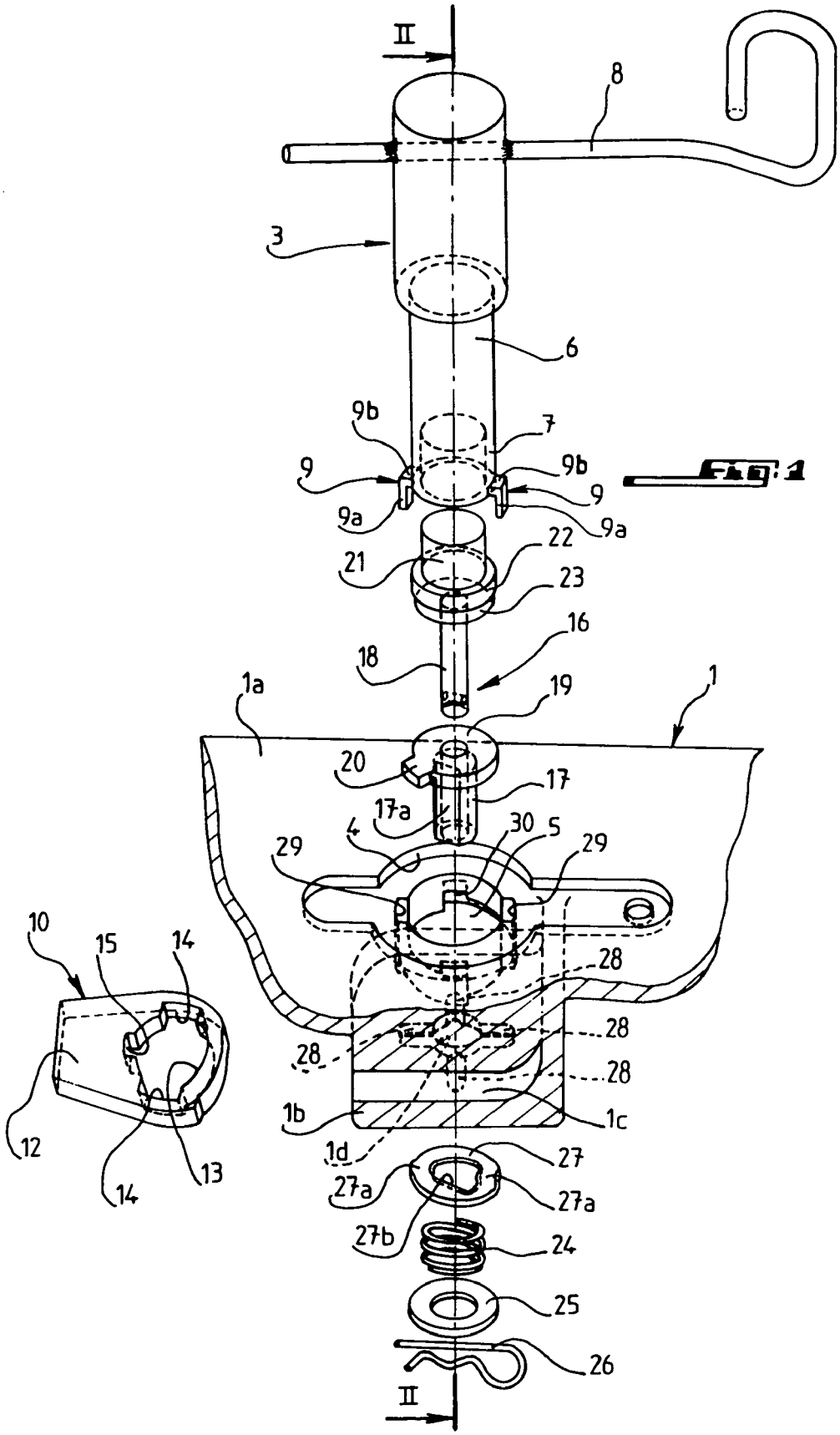
FIG. 1 is a perspective exploded view of a locking and unlocking device of a stopper on a frame according to the invention.

The locking device according to the invention that will be described is most specifically intended to equip a stopper, cover or the like 1, making it possible to close a frame, chassis or the like 2 and delimiting the opening through a manhole, for example.

The locking device can be actuated using a key 3.

The upper wall 1*a* of stopper 1 comprises an access opening 4 for the key 3 which opens on one side toward the outside of the stopper 1 and on the other side into a cavity 5 in which the unlocking mechanism that will be described below is mounted.

Key 3 comprises a cylindrical arm 6 of which one end comprises a part forming a bushing 7 and the opposite end comprises an operating handle 8 that is interdependent with this end transversally to the arm 6.

In the present case the bushing 7, which extends co-axially to the arm 6, and in the present case is implemented by a hole with a flat base at the end of the arm 6, but it could be made up by a bushing attached to the end of this arm.

The end of the arm 6 comprising the bushing 7 is equipped with two external pegs 9 connected to the arm 6, being diametrically opposed and parallel to the longitudinal axis of the arm 6. Preferably, each peg 9 is in the shape of a reversed L, of which the small branch 9*a* is interdependent radially with the end of the bushing 7 and the large branch 9*b* extends parallel to the arm 6 of the key 3, projecting beyond the opening part of the bushing 7.

The locking and unlocking mechanism comprises a lock attached to the stopper 1 and comprises a slide bolt 10 that can interact with a catch 11 of the frame 2 and made up, in the present case, by one of ribs of frame 2 making it possible to support the stopper 1. The slide bolt 10 is made up of a flat rigid plate, of which the active end 12 positions itself above the rib 11 making up the catch in locking position of stopper 1 on frame 2.

The slide bolt 10 comprises a hole 13 made near its arc-shaped end opposite the active part 12. In the hole 13, two diametrically opposed and identical radial arc-shaped notches 14 and a third radial arc-shaped notch 15 pointed toward the free active end 12 of the slide bolt plate 10 are arranged. The two notches extend along a direction perpendicular to the direction of the notch 15.

The plate of the slide bolt 10 is arranged in the stopper 1, having the part of its end comprising notches 14 and 15 in contact with the internal face of the bottom wall 1*b* of cavity 5 and its active end part 12 projecting outside the stopper across a slot that is essentially at a right angle 1*c* made in a part of the lateral wall delimiting the cavity 5 in such a way that the slide bolt 10 can pivot around one-quarter revolution from its locking position of stopper 1 with frame 2 to its position of unlocking with this stopper.

The lock additionally comprises a rotor 16 mounted with rotation in the stopper 1 and coupled with the slide bolt 10, perpendicular to the latter. The key 13 can access to the rotor 16 across the opening 4 and the cavity 5 so that it can start the rotor in rotation around its longitudinal axis and, as a result, ensure the pivoting of the slide bolt 10 along this axis between its position when it is captive with the catch 11 and its position when it is released from same.

The rotor 16 comprises a generally cylindrical barrel 17 mounted with rotation in the stopper 1 and attached in rotation to slide bolt 10 and a cylindrical axle 18 mounted loosely, i.e. able to rotate freely, in the barrel 17. The latter crosses a hole 1*d* of the bottom wall 1*b* of the cavity 5 of stopper 1 and comprises a circular head 19 with radial pin 20 being engaged in the notch 15 to connect the barrel 17 in rotation to the slide bolt 10. As can be seen better from FIGS. 2 and 3, the thickness of the circular head 19 of the barrel 17 is less than the thickness of the plate of slide bolt 10.

The cylindrical axle 18 mounted loosely in the barrel 17 comprises a cylindrical end head 21 that is fastened co-axially with axle 18 by means, successively of a shoulder with larger diameter 22 and a cylindrical bearing surface 23 lodged in the hole 13 on the circular head 19 of the barrel 17, the shoulder 22 being in contact with the plate of slide bolt 10. The diameter of the cylindrical head 21 of axle 18 is slightly less than the internal diameter of the bushing 7 of the key 3.

The cylindrical axle 18 completely crosses the barrel 17 and at its free end opposite the head 21 projects outside beyond the barrel 17.

An elastic element 24, such as a helical spring, is mounted, prestressed between the external face of the bottom wall 1*b* of cavity 5 and a washer 25 arranged co-axially around the end of barrel 17, which projects to the outside of the wall 1*b*, the washer 25 being held axially with respect to the barrel 17 by a pin 26, of which one branch crosses a hole made at the free end of the axle 18.

The elastic element 24 is in contact with the outside face of the wall 1*b* by means of a washer 27 that is slightly wavy in some locations and cooperates with the recesses 28, in the present case four in number, made in the wall 1*b* in such a way as to hold the slide bolt 10 at one or the other of its locking and unlocking positions with the stopper on frame 2. More specifically, the washer 27 comprises at least two waves or bosses 27*a* that are diametrically opposed and one or the other able to engage with the two positions locking and unlocking, respectively, in two recesses 28 that are diametrically opposed on each side of passage hole 1*d* of barrel 17. In the present case, the four recesses 28 are made up of small holes extending crosswise around the hole 1*d*.

Over almost all of its length, the barrel 17 comprises a flattened surface 17*a* cooperating with an internal flattened surface 27*b* of the washer 27 to join the latter with rotation to barrel 17.

The assembly made up by stacking washers 25, 27 and spring 24 constitutes a means that makes it possible to hold the barrel 17, elastically and axially, with its head 19 in contact with the internal face of the wall 1*b* and the axle 18 in contact by the shoulder 22 and the bearing surface 23 on the head 19 and the plate of slide bolt 10.

The lateral wall defining the cavity 5 comprises two internal grooves 29 that are parallel and diametrically opposed, in which the two pegs 9 of the bushing 7 of the key 3 can engage, respectively.

Figure 5:
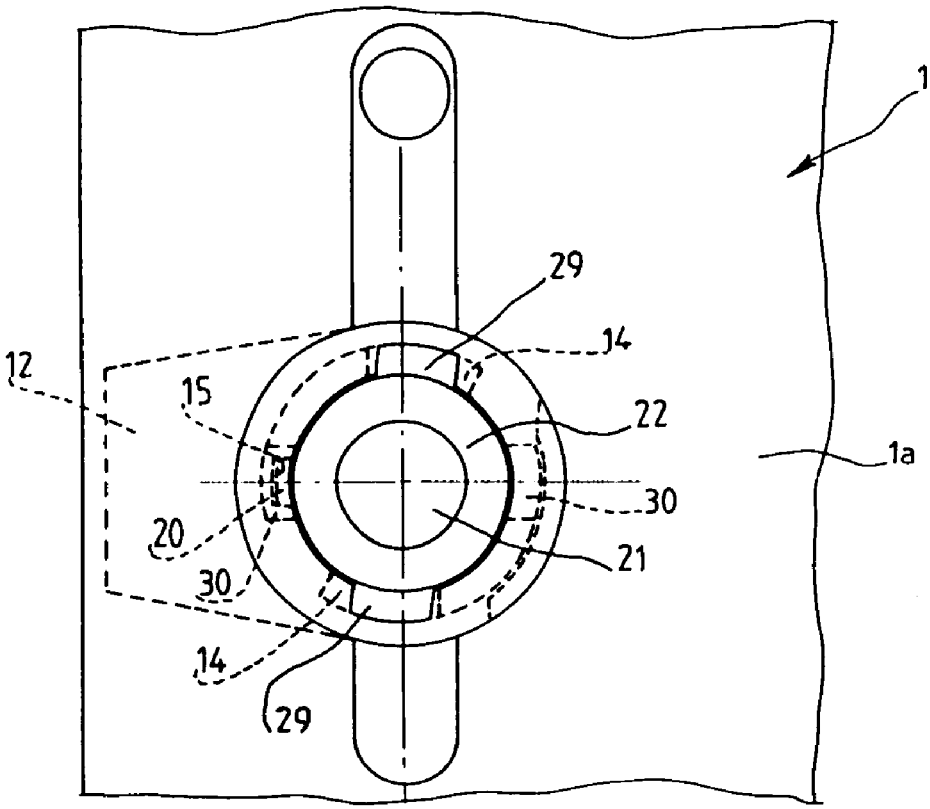
FIG. 5 is a partial top view according to arrow V in FIG. 2.

The two grooves 29 overhang the two notches 14, respectively, of the slide bolt 10 when the latter occupies its locking position of the stopper 1 with the frame 2. In addition, the length of each passage groove 29 of a peg 9 is less than the length of the notch 14 that overhangs the plate of slide bolt 10 in such a way that in the locked position of stopper 1 on frame 2, the notch 14 would be inaccessible to a tool, such as a screwdriver, introduced into opening 4 of stopper 1 and groove 29 in order to thus carry out any fraudulent manipulation for pivoting the slide bolt 10 with the use of this tool. In fact, the two radial lateral walls defining each notch 14, in the locking position of stopper 1, are located as shown in the bottom view of FIG. 5 on each side of the lateral walls of the corresponding groove 29 below the end opening into this groove in such a way that the tool cannot reach, in particular, the lateral wall of the recess 14 to make the slide bolt 10 turn in its direction for unlocking the stopper 1. If necessary, the depth of each notch 14 can be either equal or greater than the depth of the groove 29 which overhangs it in order to prevent the tool from reaching the arc-shaped wall of notch 14 and, as a result, prevent turning of the slide plate 10 in the unlocking direction of the stopper.

The lateral wall of the cavity 5 also comprises two longitudinal notches or recesses 30 that are diametrically opposed and located on each side of the grooves 29. These two notches make it possible to axially hold the pegs 9 of the bushing 7 when the key 3 has been turned to its unlocking position of the slide bolt 10 in such a way as to hold the key 3 captive on the stopper 1 when the latter is removed from its frame in order to make it impossible to lose the key 3.

The head 21 of the loosely mounted axle 18 projects into cavity 5 of stopper 1.

Figure 2:
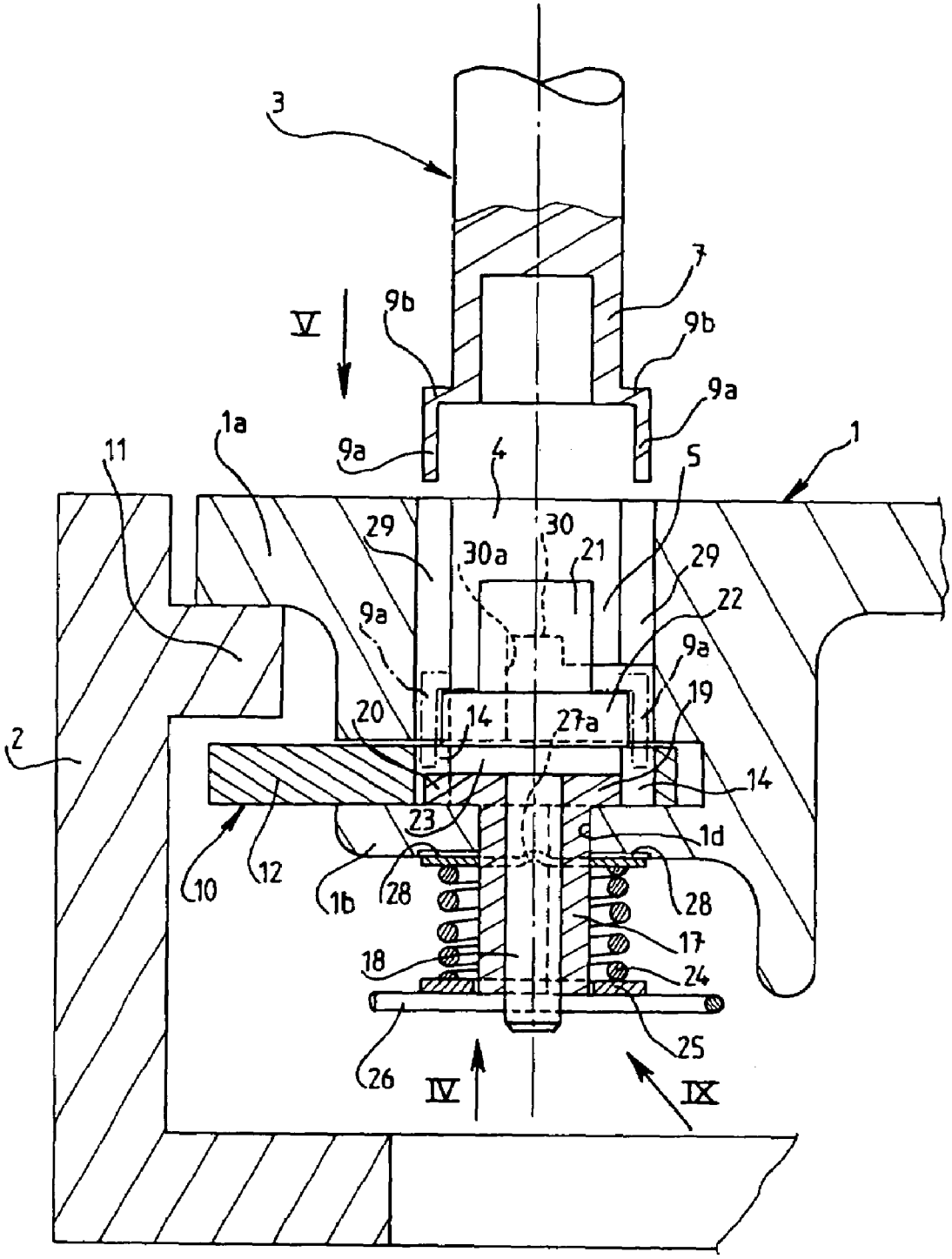
FIG. 2 is an enlarged cross section view along line II-II of FIG. 1 of the different assembled elements of the device according to the invention in the locked position of the stopper or frame.

Starting from the closed position of the stopper 1 shown in FIG. 2, the key 3 is introduced into the opening 4 and the cavity 5 in such a way that the pegs 9 engage in the grooves 29 until the ends of the branches 9*a* of the plugs engage in the two notches 14 as shown in dotted lines on this figure, the head 21 of axle 8 then being engaged in the cylindrical hole of bushing 7 to limit the depth of introduction of pegs 9 into cavity 5.

Figure 3:
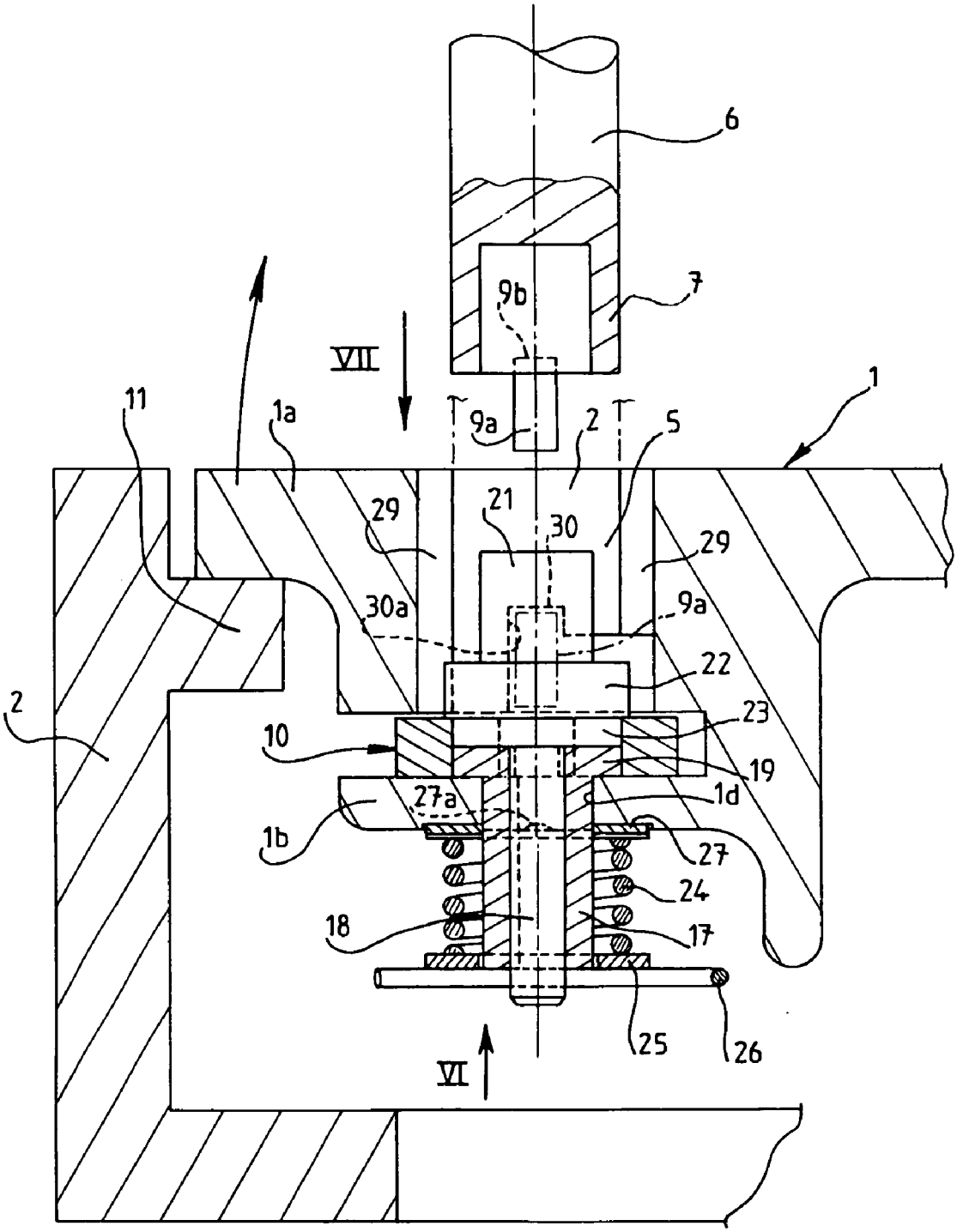
FIG. 3 is a cross section view similar to that in FIG. 2 and representing the device according to the invention in its unlocked position of the stopper of the frame.
Figure 4:
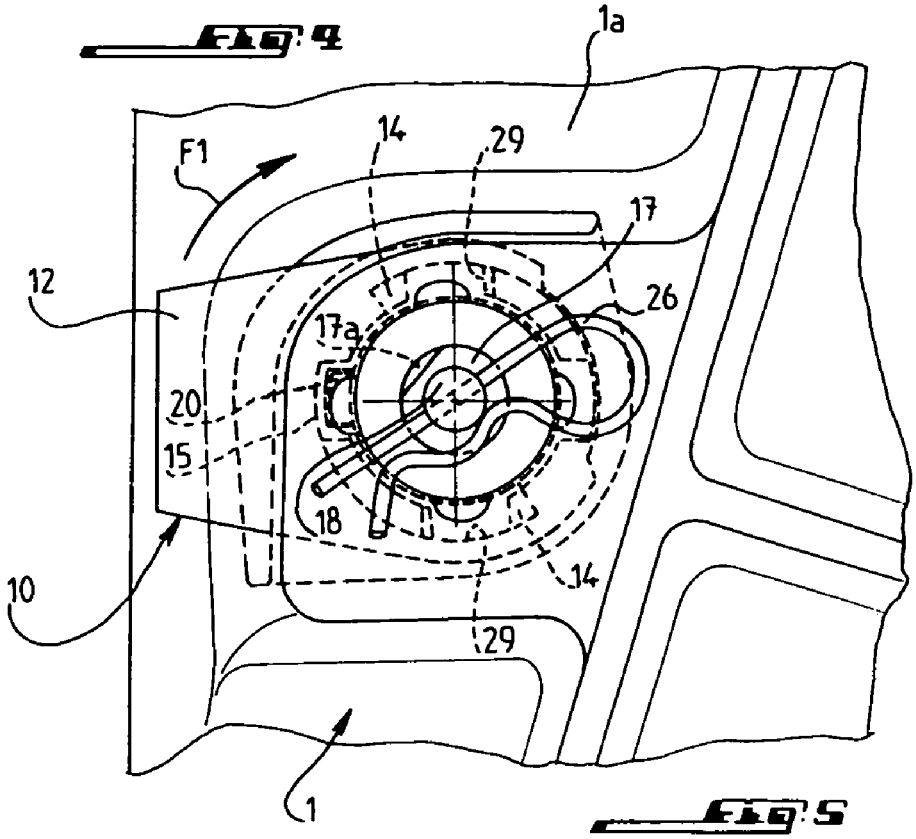
FIG. 4 is a partial top view according to arrow IV of FIG. 2.
Figure 6:
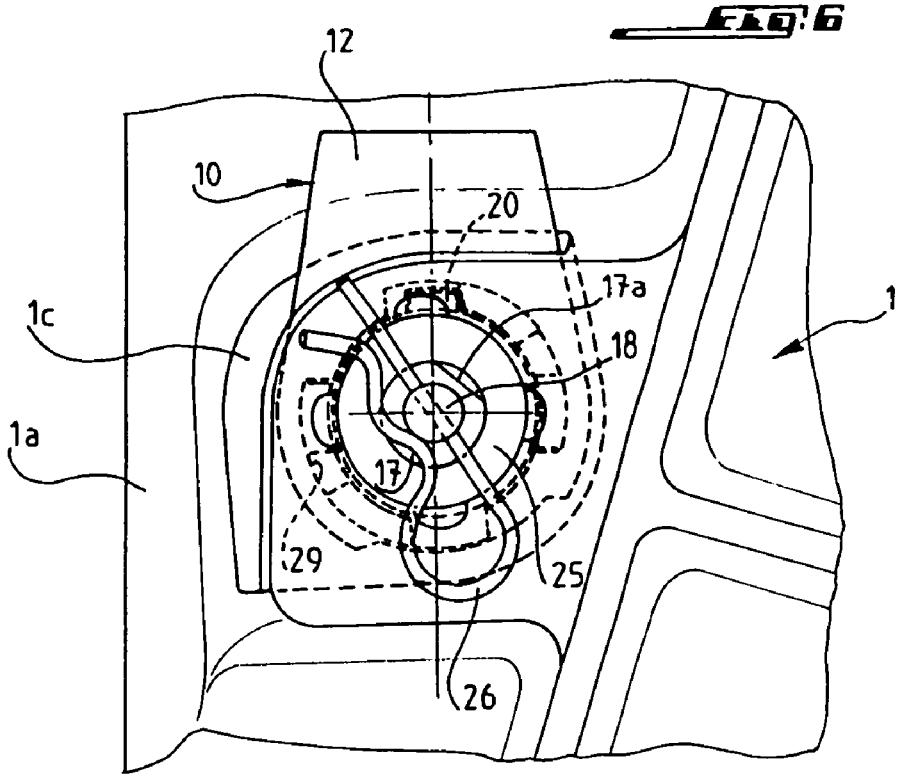
FIG. 6 is a partial top view according to arrow VI in FIG. 3.
Figure 7:
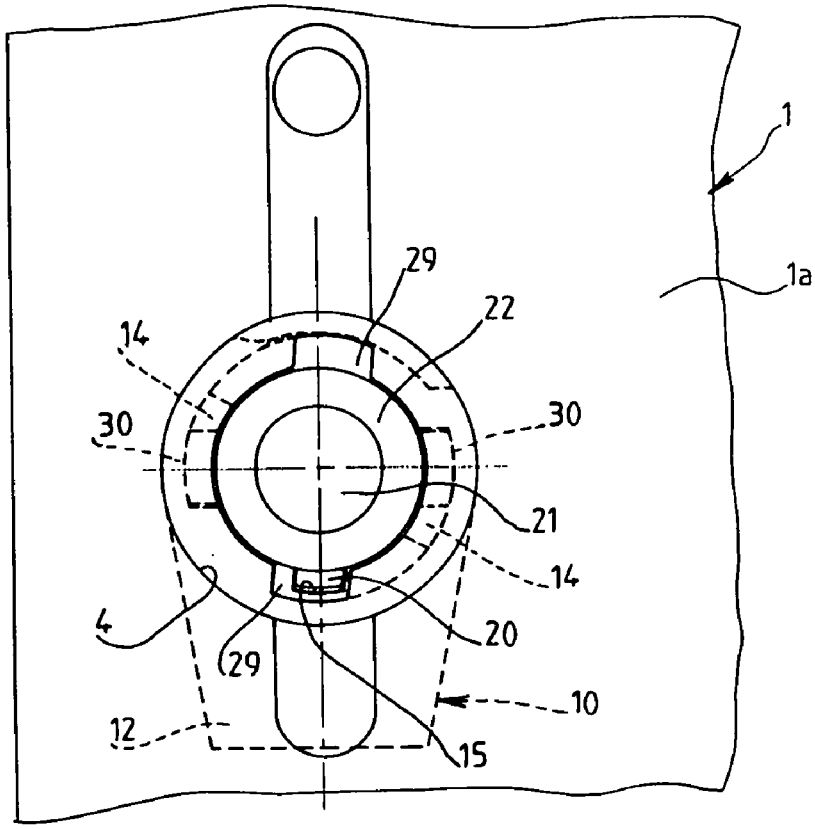
FIG. 7 is a partial top view according to arrow VII in FIG. 3.
Figure 9:
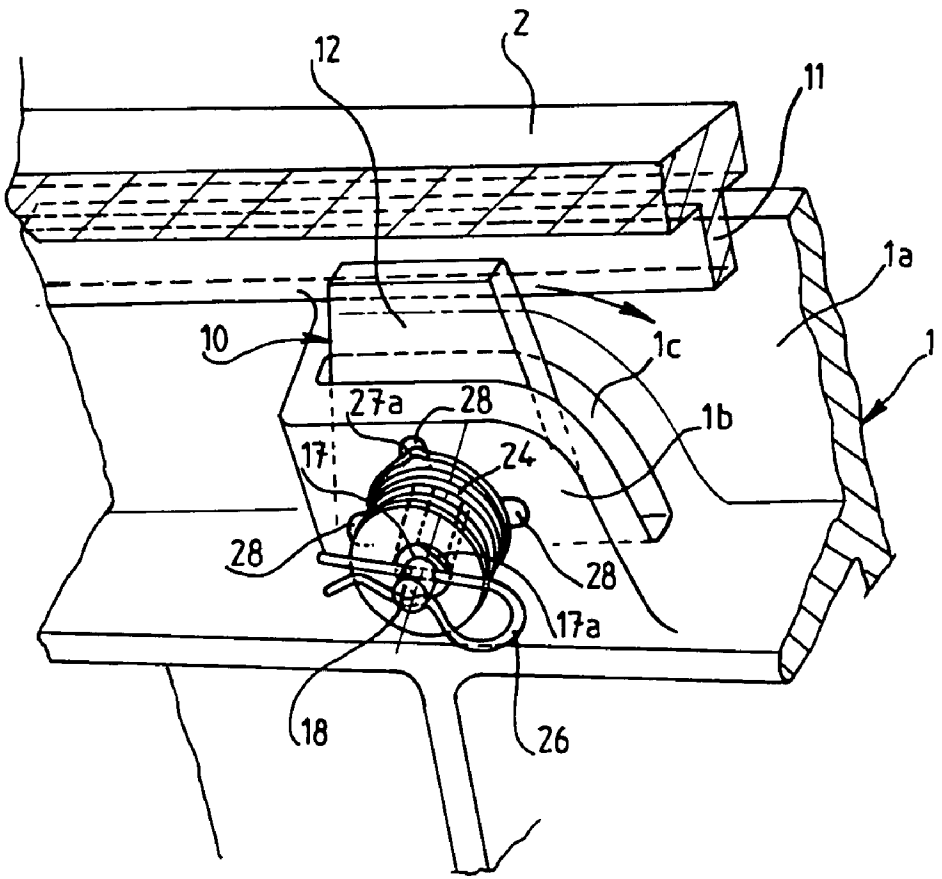
FIG. 9 is a perspective top view according to arrow IX in FIG. 2.
Figure 8:
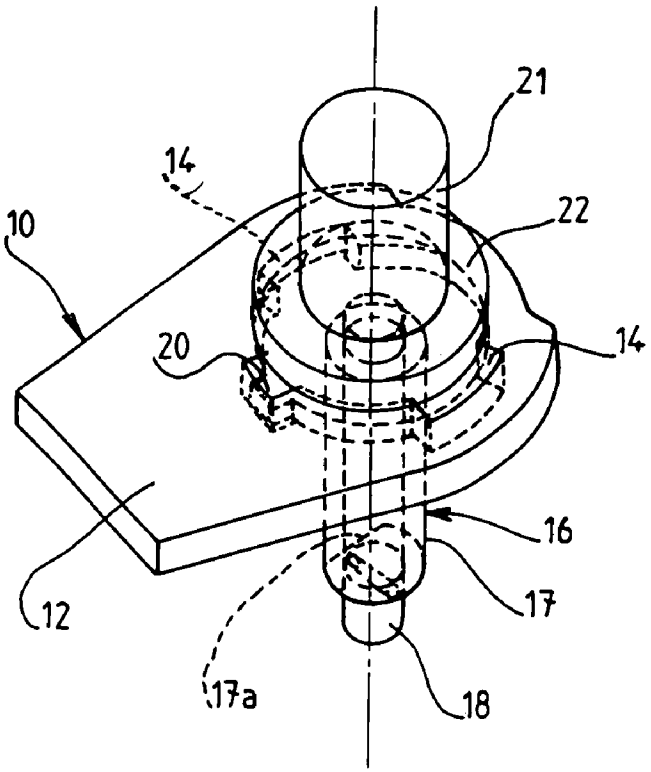
FIG. 8 is a perspective view of an assembly with rotor and slide plate of the lock or device in FIG. 1.

By then turning key 3 to unlock stopper 1 from frame 2, the branches 9*a* of pegs start in rotation, by the notches 14, the slide bolt 10 that turns with the assembly made up of the axle 18, the barrel 17, the washers 25, 27, the elastic element 24 and the pin 26 in the direction indicated by arrow F1 in FIG. 4 around one-quarter revolution to move the slide bolt 10 to its unlocked position shown in FIGS. 3, 6, 7 and at which position the stopper 1 can be removed from the frame 2. At the time when the slide bolt 10 pivots from its locking position to its unlocking position, the two bosses 27*a* or the washer 27 leave their engagement position, respectively in two of the recesses 28 that are diametrically opposed, to engage in the two other recesses 28 that are diametrically opposed due to the return force of the elastic element 24. In unlocking position, the pegs 9 are held axially by their radial branches 9*b* in the two recesses 30 in such a way as to hold key 3 in the stopper 1 so that it will not be locked again to frame 2. Each notch 30 comprises a lateral wall 308 serving as a stop for the corresponding branch 9*a* of the bushing 7 in such a way as to limit the rotation of the key to the angular value of one-quarter revolution.

To close frame 2, all that is necessary is to place stopper 1 on the ribs 11 and, by turning the key in the direction opposite to arrow F1, the slide bolt 10 is moved into its locking position below the corresponding rib 11 and the key can be freely removed from stopper 1.

In the locked position of stopper 1 on frame 2, any unauthorized person who is not in possession of the key 3 cannot unlock the lock. In fact, the use e.g. of pliers acting on the cylindrical head 21 will do nothing but freely turn the cylindrical axle 18 in the barrel 17, which is inaccessible from the outside, and as a result, this eliminates the risk of causing the slide bolt 10 to turn. In addition, as already explained above, the introduction of a screwdriver into one or the other of the grooves 29 will not work for making the slide bolt 10 turn, since the notches 14 of the slide bolt 10 are inaccessible across these grooves.

The invention claimed is:

1. Locking and unlocking device with a key for a cover on a frame, comprising:

a lock that is interdependent with the cover and the lock has an access opening for the key, the lock comprising;

an arm having a bushing on an end of the arm that makes it possible to manipulate the lock when the key is introduced into the opening of the cover from a locking position, in which a slide bolt of the lock is held captive by a catch of the frame, to an unlocking position for which the slide bolt is released from the catch and the key is held captive in the opening of the cover, a rotor mounted for rotation in the cover, the rotor being accessible through the opening and coupled with the slide bolt, and the rotor being disposed perpendicular with the slide bolt in such a way as to allow the pivoting of the slide bolt around a longitudinal axis of the rotor due to the action of the key, between the locking and unlocking positions when the rotor is captive in and released from the catch, wherein the rotor of the lock comprises a generally cylindrical barrel mounted for rotation in the cover and being interdependent in rotation with the slide bolt and a cylindrical axle mounted loosely in the barrel, the cylindrical axle comprising:

a cylindrical head in contact on the barrel and lodged in a cavity of the cover that is accessible from the outside through the opening of the cover and wherein means are provided for elastically and axially holding, in the cover, the barrel and the cylindrical axle, wherein the cylindrical head engages axially in the bushing of the key at the time of introduction of the cylindrical head into the cavity of the cover.

2. Device according to claim 1, wherein the slide bolt is made of a flat rigid plate having, in the area of one end of the plate, a hole in which two diametrically opposed radial arc-shaped notches are arranged and a third radial arc-shaped notch is pointed toward an opposite active free end of the plate of the slide bolt, wherein the barrel crosses the bottom wall of the cavity of the cover and comprises a circular head with radial pin engaged in the third notch of the slide bolt, the cylindrical head of the loose axle being in contact with the circular head of the barrel and engageably axially in the bushing of the key at the time of introduction of the cylindrical head into the cavity of the cover, wherein the bushing of the key comprises two diametrically opposed parallel external pegs that are able to engage, respectively, in the two opposing notches of the slide bolt in the locked position of the cover in the frame across from two diametrilcally opposed grooves of the lateral wall of cavity overhanging the two opposing notches of slide bolt and making it possible to bring into rotation of about one-quarter revolution the assembly with the loose axle, barrel and plate of the slide bolt by turning the key in a direction to move the slide bolt to an unlocking position, at which point the key is captive in the cover by the two pegs held axially, respectively, in two longitudinal recesses of the lateral wall of the cavity.

3. Device according to claim 2, wherein the length of each passage groove for a peg of the bushing of the key is smaller than the length of the notch that overhangs the plate of the slide bolt in a locked position of the cover in the frame in such a way that the notch would be inaccessible to a tool introduced into the opening of the cover and the groove to prevent any fraudulent manipulation of the slide bolt using the tool.

4. Device according to claim 2, wherein each peg of the bushing of the key has the shape of a reversed L, of which a small branch of the reversed L is interdependent radially with the bushing, and the other branch parallel to the arm of the key projects beyond the opening part of the bushing.

5. Device according to claim 1, wherein the plate of the slide bolt and the circular head of the barrel are in contact on the internal face of the bottom wall of cavity of the cover, and the means that elastically hold the head of the barrel in contact with the bottom wall and the cylindrical head of the loose axle on the head of the barrel comprise an elastic element mounted coaxially to a part of the barrel located on the outside of the bottom wall, the elastic element being prestressed between the external face of the bottom wall and a contact washer held axially with respect to the barrel by a pin crossing the free end of the loose axle projecting from the barrel.

6. Device according to claim 5, wherein the elastic element is in contact on the external face of the bottom wall by way of a wavy washer that is interdependent in rotation with the barrel and cooperates with four recesses made in this external face and spaced regularly around the passage hole of the barrel across from the bottom wall, at the time of rotation of the barrel, to position the slide bolt at one or the other of the locking and unlocking positions of the stopper on the frame.

7. Device according to claim 6, wherein the barrel comprises a flattened surface that works together with a flattened surface of the wavy washer to start the wavy washer in rotation when the slide bolt pivots.

8. Device according to claim 1, wherein the slide bolt projects to the outside of the lateral wall of the cavity of stopper the cover through a slot making it possible for the slide bolt to pivot around one-quarter revolution.

9. Locking and unlocking device with a key for a cover on a frame, comprising:

a lock that is interdependent with the cover and the lock has an access opening for the key, the lock comprising:

an arm having a bushing on an end of the arm that makes it possible to manipulate the lock when the key is introduced in to the opening of the cover from a locking position, in which a slide bolt of the lock is held captive by a catch of the frame, to an unlocking position for which the slide bolt is released from the catch and the key is held captive in the opening of the cover, a rotor mounted for rotation in the cover, the rotor being accessible through the opening and coupled with the slide bolt, and the rotor being disposed perpendicular with the slide bolt in such a way as to allow the pivoting of the slide bolt around a longitudinal axis of the rotor due to the action of the key, between the locking and unlocking positions when the rotor is captive in and released from the catch, wherein the rotor of the lock comprises a generally cylindrical barrel mounted for rotation in the cover and being interdependent in rotation with the slide bolt and a cylindrical axle mounted loosely in the barrel, the cylindrical axle comprising:

a cylindrical head in contact on the barrel and lodged in a cavity of the cover that is accessible from the outside through the opening of the cover and wherein means are provided for elastically and axially holding, in the cover, the barrel and the cylindrical axle, wherein the slide bolt is made of a flat rigid plate having. in the area of one end of the plate, a hole in which two diametrically opposed radial arc-shaped notches are arranged and a third radial arc-shaped notch is pointed toward an opposite active free end of the plate of the slide bolt, wherein the barrel crosses the bottom wall of the cavity of the cover and comprises a circular head with radial pin engaged in the third notch of the slide bolt, the cylindrical head of the loose axle being in contact with the circular head of the barrel and engageable axially in the bushing of the key at the time of introduction of the cylindrical head into the cavity of the cover, wherein the bushing of the key comprises two diametrically opposed parallel external pegs that are able to engage, respectively, in the two opposing notches of the slide bolt in the locked position of the cover in the frame across from two diametrically opposed grooves of the lateral wall of cavity overhanging the two opposing notches of slide bolt and making it possible to bring into rotation of about one-quarter revolution the assembly with the loose axle, barrel and plate of the slide bolt by turning the key in a direction to move the slide bolt to the unlocking position, at which point the key is captive in the cover by the two pegs held axially. respectively, in two longitudinal recesses of the lateral wall of the cavity.

* * * * *